United States Patent [19]

Pattillo et al.

[11] 4,376,463

[45] Mar. 15, 1983

[54] METHOD OF APPLYING TENSILE STRESS TO A CASING

[75] Inventors: Phillip D. Pattillo, Tulsa, Okla.; William H. Wadlington, Barrington, Ill.

[73] Assignee: Standard Oil Company (Indiana), Chicago, Ill.

[21] Appl. No.: 293,754

[22] Filed: Aug. 17, 1981

Related U.S. Application Data

[63] Continuation of Ser. No. 151,211, May 19, 1980, abandoned, which is a continuation of Ser. No. 964,859, Nov. 30, 1978, abandoned.

[51] Int. Cl.[3] ..... E21B 33/14; E21B 33/16

[52] U.S. Cl. ..... 166/285; 166/291

[58] Field of Search ..... 166/122, 212, 242, 285, 166/291

[56] References Cited

U.S. PATENT DOCUMENTS

| | | | |
|---|---|---|---|
| 1,563,520 | 12/1925 | Owen | 166/285 |
| 2,050,970 | 8/1936 | Hughes | 166/212 X |
| 3,055,424 | 9/1962 | Allen | 166/242 X |
| 3,545,543 | 12/1970 | Krammerer, Jr. et al. | 166/212 |
| 3,581,817 | 6/1971 | Krammerer, Jr. | 166/212 X |
| 3,593,795 | 7/1971 | Broussard, Sr. | 166/285 |
| 3,976,139 | 8/1976 | Wilder | 166/285 |
| 4,155,404 | 5/1979 | Hollingsworth | 166/285 |

*Primary Examiner*—Stephen J. Novosad
*Assistant Examiner*—George A. Suchfield
*Attorney, Agent, or Firm*—Scott H. Brown; Fred E. Hook

[57] ABSTRACT

This is a method of cementing casing under tension. Internal pressure is applied to a casing string set in the borehole after cement has been placed between the casing and the borehole wall. This results in a lengthening of the string. Anchor means are next set in the well wall and pressure released prior to setting of the cement to leave the string with an additional tensile loading.

5 Claims, 4 Drawing Figures

METHOD OF APPLYING TENSILE STRESS TO A CASING

This is a continuation of application Ser. No. 151,211, filed May 19, 1980, abandoned, which is a continuation of application Ser. No. 964,859, filed Nov. 30, 1978, abandoned.

BACKGROUND OF THE INVENTION

1. Field of the Invention

This invention relates to a method and apparatus of cementing casing in a wellbore and normally in a wellbore in which the casing will subsequently be heated to a higher temperature, causing it to have a tendency to elongate. It particularly concerns a method whereby the casing can be elongated without applying an upward mechanical force at the surface.

2. Setting of the Invention

In the search for oil and gas, boreholes are drilled deep into the earth. These holes are lined with casing, which is usually heavy steel pipe, and cement is forced between the casing and the borehole wall. In most cases, during production of oil and gas, the temperature of the casing doesn't vary much from what it is when it is originally set. However, in a growing number of situations, the fluid flowing through the wellbore is of such a high temperature that the casing is heated to a much higher temperature from that which it was when the casing was set. A thermal well can be a well in which steam or other hot fluid is injected down through a tubing string, suspended in the wellbore to aid in the recovery of fluid from the underground formation, or it can be a well which produces fluid from a formation which has a very high temperature. The increased temperature causes elongating stresses to be setup in the casing. It has been found that if the casing is hung and cemented and then large temperature differences are added to the casing, the tensile stress change for the fixed cementing casing is approximately 200 psi per degree Fahrenheit change.

In conventionally cementing a casing string in a wellbore, the casing string is preferably reciprocated and rotated during the placing or circulation of the cement between the outer wall of the casing and the wellbore. However, frequently, the reciprocation and rotation are dispensed with although it is normally desired if possible. The present invention permits conventional placing of cement, with or without reciprocation and rotation, and then placing the casing at extra tension while the cement sets. The extra-tensile stressing of the casing is then retained after the cement sets. This extra tensile stressing prevents heat from causing destructive compressive stresses in the casing once hot fluids are passed therethrough.

Instability in a casing string can be defined as lateral deflection of the casing due to buckling. The detrimental effects of instability in casing strings have long been recognized. These effects include not only damage to the casing string through excessive deformations, but also casing wear due to movement of drilling or production equipment through a buckled string of casing. Casing buckling can occur both above the cement top and in washouts below the cement top. At the present time, there exist three recognized procedures for increasing the stability of a casing string:

(1) Adjust pull/slackoff.

(2) Adjust cement height.

(3) Apply internal surface pressure during WOC (Waiting on Cement to set) time.

All three of the methods listed above will increase the stability of a casing string above the cement top. Only the last method will increase the stability of a casing string in a washout below the cement top.

Unfortunately, the three methods of increasing casing stability listed in the previous paragraph are not always easily applied in the field. Increasing the stability of a casing string by physically pulling on the string at the surface is a difficult job requiring jacking mechanisms. The foundation in the vicinity of the wellhead may not always be sufficient to support such an operation. Adjusting cement height is a fairly uncomplicated procedure. However, experience has shown that, especially in deep or wildcat wells, one cannot always be assured that his cement level will reach the anticipated position. The last method of increasing stability, application of internal surface pressure while waiting for the cement to take its initial set, is in many cases totally unsatisfactory. Application of internal pressure not only applies a tension force to the bottom of the string, but it also expands the casing radially. Once the cement has set and the internal surface pressure has been released, one is left with a microannulus between the casing string and the protective cement sheath. In operations where isolation of zones is of primary concern, this microannulus cannot be tolerated. The practice of the present invention prevents the formation of such microannulus.

BRIEF SUMMARY OF THE INVENTION

This is a method of setting a casing string under tension in a wellbore which includes placing cement in at least a part of the annulus between the wall of the wellbore and a string of casing hung in such wellbore. The upper end of the casing string is maintained in essentially a fixed position. Thereafter, pressure is applied to the interior of the string of casing to cause elongation. While in the elongated position, the lower end of the casing is anchored to the wall of the wellbore. We then release the fluid pressure prior to the setting of the cement.

BRIEF DESCRIPTION OF THE DRAWINGS

A better understanding of the invention and various modifications can be made from the following description taken in conjunction with the drawings in which.

DETAILED DESCRIPTION OF THE INVENTION

Figures 1, 2, 3, 4:
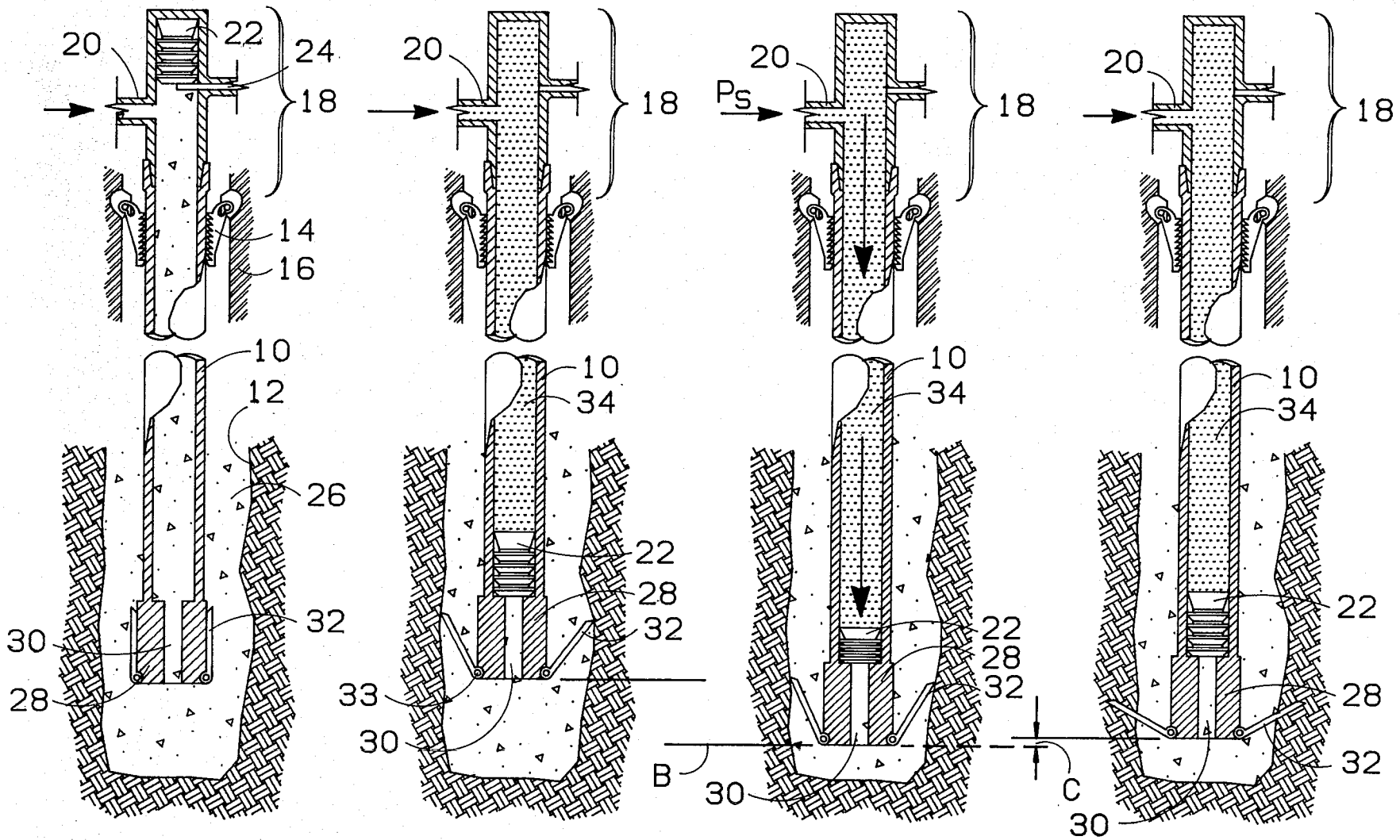
FIG. 1 illustrates a string of casing suspended in a wellbore with an unactuated anchor means at the lower end thereof.
FIG. 2 is similar to FIG. 1 except that cement has been displaced out of the casing string and the anchor means extended.
FIG. 3 is similar to FIG. 2 except that it illustrates fluid pressure within the casing string causing it to elongate.
FIG. 4 is similar to FIG. 3 except that the anchors have been firmly embedded in the earthen formation.

Attention is first directed to FIG. 1 which shows a casing string 10 suspended in a borehole 12 and is supported by slips 14 from a surface or other previously set casing 16 which extends to the earth's surface. A cementing head 18 is indicated at the top of casing 10 at the surface. The casing head includes an inlet 20, a wiper plug 22 supported by lever means 24 which holds it in place. Cementing heads are well known and it is only shown schematically in this drawing and does not show in detail the various valves, etc.

A casing anchor 28 is provided at the lower end of casing string 10. This includes a vertical passage 30 and anchor bars 32. Anchor means 28 can be an anchoring system such as shown in U.S. Pat. No. 3,976,139, Lawrence B. Wilder, inventor, issued Aug. 24, 1976, for "Anchoring for Tensioning Casing in Thermal Wells," Standard Oil Company (Indiana), Assignee.

FIG. 1 illustrates the stage of this process wherein cement is being pumped in through inlet 20 down the interior of casing string 10 to vertical passage 30 into the annular space 26 between the exterior casing 10 and the borehole wall 12. Cementing will continue to be pumped into the casing string 10 until a sufficient amount has been placed in the annulus 26.

FIG. 2 illustrates the next stage of the process of this invention. Cement injection or pumping through the inlet 20 has stopped and has been replaced by the pumping in of a suitable drilling mud. Before the drilling mud has been pumped in, the wiper plug 22 has been released and it in effect separates the cement from the drilling mud 34. Drilling mud is pumped into the casing 10 until the plug 22 rests on anchor means 28 and seals passage 30. The anchor on members 32 are extended horizontally about pivot 33 in the manner described in said U.S. Pat. No. 3,976,139. It is to be understood that the process of this invention is not tied to that particular anchor described in that patent, but is applicable for use with any suitable anchor on the lower end of a string of casing. The lower end of the anchor 28 in the stage of FIG. 2 may be slightly higher than the lower end of the anchor in FIG. 1 and this is due to the fact that the drilling fluid 34 is lighter than the cement which is in the casing 10 in FIG. 1. However, this is of no real importance.

Attention is next directed to FIG. 3. Prior to the initial cement set, an internal pressure $P_s$ is applied to the interior of casing string 10. This moves the lower end of the casing string to position B. By applying the surface pressure $P_s$ in the stage shown in FIG. 3, the casing anchor described in said U.S. Pat. No. 3,976,139 may be set at the desired position.

Prior to the initial cement set, we released surface pressure $P_s$ so that the casing and anchor is in the state illustrated in FIG. 4. As can be seen, the anchor bars 32 are firmly embedded in the formation. It will be noted that the lower end of casing anchor 28 has raised a small amount "c", as indicated by elevation lines in FIGS. 3 and 4, due to the release of pressure and in an amount determined largely by the embedding of anchor bars 32 into the earth's formation. This is a rather small decrease in length. Due to the fact that surface pressure $P_s$ is released prior to the initial cement set, the possibility of a microannulus forming between the cement and the lower end of the casing 10 is eliminated.

As an example of the tensile loadings that may be achieved with the above-described procedure, consider the following formula for the axial strain of a thick cylinder subjected to axial load and/or internal pressure:

$$\epsilon_w = \frac{1}{E}\,\sigma_w - 2\mu\,\frac{P_i r_i^2}{r_o^2 - r_i^2} \tag{1}$$

where $\epsilon_w$ is axial strain,
E is Young's Modulus,
$\sigma_w$ is axial stress,
$\mu$ is Poisson's ratio,
$P_i$ is internal pressure,
$r_i$ is internal radius, and
$r_o$ is external radius.

The additional axial strain due to application of internal surface pressure is given by $$\epsilon_w = \frac{1}{E}\,\frac{P_i r_i^2}{r_o^2 - r_i^2}\,(1 - 2\mu) \tag{2}$$

The additional axial strain due to pulling on the casing with a force $F_w$ at the surface is given by $$\epsilon_w = \frac{1}{E}\,\frac{F_w}{\pi(r_o^2 - r_i^2)} \tag{3}$$

The relation between $P_i$ and $F_w$ may be arrived at by comparing Equations (2) and (3), $$P_i = \frac{F_w}{\pi r_i^2(1 - 2\mu)} \tag{4}$$

As an example, for $9\frac{5}{8}$", 47 lb/ft casing, and $\mu=0.3$, the denominator of Equation (4) is 23.7. This implies that an axial strain corresponding to 100,000 pounds of mechanical pull can be alternatively achieved by the application of a surface pressure of 4220 pounds. Therefore, the application of internal pressure prior to cement set can be likened to an additional pull above the cement top after initial cement set. However, in addition, this load will also appear below the cement top to aid string stability in washouts.

While the above has described the invention in detail, various modifications can be made thereto without departing from the spirit and scope of the invention.

What we claim is:

1. A method of setting a string of casing in a wellbore comprising:

(a) suspending the string of casing in the wellbore,
(b) placing cement in at least a part of the annulus between the string of casing and the wall of the wellbore thereby surrounding a portion of the casing with cement,
(c) longitudinally elongating the string of casing in a downward direction causing elongation of the said portion of casing, and
(d) maintaining prior to the setting of said cement the longitudinal elongation of the portion of the string of casing surrounded by said cement.

2. A method of setting a string of casing in a wellbore comprising:

(a) suspending the string of casing in the wellbore,
(b) placing cement in at least a part of the annulus between the string of casing and the wall of the wellbore,
(c) longitudinally extending the string of casing in a downward direction while maintaining the upper end thereof in essentially a fixed position, and
(d) anchoring, prior to the setting of said cement, the string of casing within the wellbore below the top level of said cement.

3. A method of setting a string of casing in a wellbore comprising:

(a) suspending the string of casing in the wellbore, (b) placing cement in at least a part of the annulus between the string of casing and the wall of the wellbore, (c) applying pressure to the interior of the string of casing to cause downward elongation of the string of casing, (d) anchoring the string of casing within the wellbore below the top level of said cement, and (e) releasing said pressure prior to the setting of said cement.

4. A method as in claim 2 or 3 wherein said step of anchoring includes anchoring the extended lower end of the string of casing to the wall of said wellbore.

5. A method as in claim 3 in which the step of applying pressure to the interior of the string of casing includes the step of sending a cement wiper plug to the bottom of the string of casing to form a plug at the lower end thereof.

* * * * *